US007418838B2

(12) United States Patent
Heo et al.

(10) Patent No.: US 7,418,838 B2
(45) Date of Patent: Sep. 2, 2008

(54) WASHER

(75) Inventors: Seong Eun Heo, Gyeongsangnam-do (KR); Dong Yoon Kim, Gyeongsangnam-do (KR); Jae Chul Lyu, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 666 days.

(21) Appl. No.: 10/480,994

(22) PCT Filed: Apr. 17, 2003

(86) PCT No.: PCT/KR03/00777

§ 371 (c)(1),
(2), (4) Date: Dec. 17, 2003

(87) PCT Pub. No.: WO03/089707

PCT Pub. Date: Oct. 30, 2003

(65) Prior Publication Data

US 2004/0172986 A1 Sep. 9, 2004

(30) Foreign Application Priority Data

Apr. 17, 2002 (KR) ..... 10-2002-0021034
Apr. 16, 2003 (KR) ..... 10-2003-0023883

(51) Int. Cl.
*D06F 39/14* (2006.01)

(52) U.S. Cl. ..... 68/3 R; 68/213

(58) Field of Classification Search ..... 68/3 R, 68/213; 134/56 R

See application file for complete search history.

(56) References Cited

U.S. PATENT DOCUMENTS 2,328,073 A * 8/1943 Hanney ..... 68/12.19
4,047,242 A * 9/1977 Jakob et al. ..... 361/714
4,510,778 A * 4/1985 Cotton ..... 68/12.15
5,243,453 A * 9/1993 Kawaguchi et al. ..... 349/60
5,321,229 A * 6/1994 Holling et al. ..... 219/445.1
5,334,799 A * 8/1994 Naito et al. ..... 174/17 VA
5,685,623 A * 11/1997 Katz et al. ..... 312/263
5,786,987 A * 7/1998 Barbier et al. ..... 361/732
5,905,551 A * 5/1999 Sanpei et al. ..... 349/60
6,067,229 A * 5/2000 Johnson et al. ..... 361/704
6,101,090 A * 8/2000 Gates ..... 361/690
6,642,446 B2 * 11/2003 Dodds et al. ..... 174/50
6,768,279 B1 * 7/2004 Skinner et al. ..... 318/254
7,000,436 B2 * 2/2006 Peterson ..... 68/12.04

FOREIGN PATENT DOCUMENTS

| | | | |
|---|---|---|---|
| BR | 9900315 | * | 7/2000 |
| FR | 2 840 006 | * | 10/1981 |
| GB | 2 292 391 A | | 2/1996 |
| JP | 59-214288 | * | 12/1984 |
| JP | 1-317494 | * | 12/1989 |

(Continued)

OTHER PUBLICATIONS

WIPO WO 02/12610 Feb. 2000.*

*Primary Examiner*—Frankie L Stinson
(74) *Attorney, Agent, or Firm*—McKenna Long & Aldridge LLC

(57) ABSTRACT

A washer includes an outer cabinet, a washtub disposed in the cabinet, a rotating tub rotating by a driving motor and being disposed in the washtub, a top cover disposed on top of the cabinet, the top cover being provided with an opening for loading and unloading clothes, a control box-receiving portion formed on a portion of the top cover, a control box having a circuit board for controlling the washer, the control box removably received in the control box-receiving portion, and a protecting cover for covering the portion of the top cover where the control box is received.

18 Claims, 6 Drawing Sheets

FOREIGN PATENT DOCUMENTS

| | | | |
|---|---|---|---|
| JP | 3-103299 | * | 4/1991 |
| JP | 3-121199 | * | 5/1991 |
| JP | 7-204384 | * | 8/1995 |
| JP | 8-164296 | * | 6/1996 |
| JP | 8164296 | | 6/1996 |
| JP | 9-28651 | * | 2/1997 |
| JP | 09-117588 | | 5/1997 |
| JP | 9-117588 | * | 5/1997 |
| JP | 11-333190 | | 12/1997 |
| JP | 11-009889 | | 1/1999 |
| JP | 5-192490 | | 8/1999 |
| JP | 11-243283 | * | 9/1999 |
| JP | 11-285594 | | 10/1999 |
| JP | 11-300088 | | 11/1999 |
| JP | 2000-70589 | | 3/2000 |
| JP | 2000-228243 | * | 8/2000 |
| JP | 2000-254391 | | 9/2000 |
| JP | 2000252663 | * | 9/2000 |
| JP | 2002-271381 A | | 10/2000 |
| JP | 2000-316785 | * | 11/2000 |
| KR | 000055025 A | | 9/2000 |
| KR | 010007670 A | | 2/2001 |
| KR | 10-2001-0036341 | | 5/2001 |

* cited by examiner

WASHER

TECHNICAL FIELD

The present invention relates to a washer, and more particularly, to a control box assembly of a washing machine, which processes power switching signals and valve on/off signals through a variety of wires.

BACKGROUND ART

In recent years, washing machines have been designed to be fully automatic in performing washing processes such as a wash cycle, a rinse cycle, and a spin cycle. Such automatic processes are realized by turning electric Signals on and off and switching electric power supplies. The turning of electric signals and the switching of electric power supplies are controlled by a central process unit formed on a circuit board received in a control box.

FIG. 1 shows a conventional washing machine.

As shown in the drawing, the conventional washing machine comprises an outer cabinet 1, a washtub 2 disposed in the cabinet 1, a rotating tub 3 disposed in the washtub 2, a top cover 4 disposed on a top of the cabinet 1, a lid for opening a portion of the top cover 4, a machinery part disposed on a rear portion of the top cover 4, a water supply part 6 mounted on a rear portion of the washing machine, and a control box 8 disposed on an inner wall of the cabinet 1 to control the operation of the mechanical part 7 and the rotating tub 3.

The mechanical part 7 includes a plurality of electric facilities such as a water level sensor, a power supply switch and the like.

Particularly, the control box 8 is electrically connected to a driving motor for driving the rotating tub 3 and the electric facilities of the mechanical part 7 by a plurality of wires.

Such a conventional washing machine has a problem that a short circuit may be incurred due to water infiltrating the control box. The water infiltration may cause the fire.

Furthermore, since the control box 8 is disposed on the inner wall of the cabinet 1, it is troublesome to install the control box 8 on such a location in the assembling line and repair the same.

In addition, although the control box 8 is disposed on a location that is remote from the mechanical part 7 and the water supply part 6 except for the driving motor for driving the rotating tub 3. As a result, lengthened wires are required to connect the control box 8 to the mechanical part 7 and the water supply part 6, resulting in increasing the manufacturing costs.

Furthermore, since the control box is not exposed to the air, it is likely to contact moisture causing the short circuit.

DISCLOSURE OF THE INVENTION

Accordingly, it is an objective of the present invention to provide washing machine having an assembly of a control box and a control box receiving structure, which is designed to prevent short circuits by suppressing infiltration of washing water into the control box.

It is another objective of the present invention to provide a washing machine having an assembly of a control box and a control box receiving structure, which is designed to be easily installed and repaired.

It is still another objective of the present invention to provide an assembly of a control box and a control box receiving structure, which can reduce the manufacturing costs of the washing machine by being able to have its installation location changed.

It is still yet another objective of the present invention to provide washing machine having an assembly of a control box and a control box, which can improve the reliability of the control box by preventing the control box from being exposed to moisture.

To achieve the above objects, the present invention provides a washing machine comprising an outer cabinet; a washtub disposed in the cabinet; a rotating tub rotating by a driving motor and being disposed in the washtub; a top cover disposed on top of the cabinet, the top cover being provided with an opening for loading and unloading clothes; a control box-receiving portion formed on a portion of the top cover; a control box having a circuit board for controlling the washing machine, the control box removably received in the control box-receiving portion; and a protecting cover for covering the portion of the top cover where the control box is received.

According to another aspect, the present invention provides a method for installing a control box in a washing machine, the method comprising the steps of seating the control box on a portion of the top cover; securely fixing the control box on the top cover using a screw; and covering the portion where the control box is seated using a protecting cover.

Therefore, The present invention has an advantage of suppressing short circuits that may be caused by water infiltrating the control box, thereby reducing the risk of fire caused by the short circuit.

The present invention has another advantage of making it easy to install and repair the control box.

The present invention has still another advantage of reducing the manufacturing cost by changing the installing location of the control box.

BEST MODE FOR CARRYING OUT THE INVENTION

Hereinafter, preferred embodiments of the present invention will be described in detail with reference to the accompanying drawings.

Figure 1:
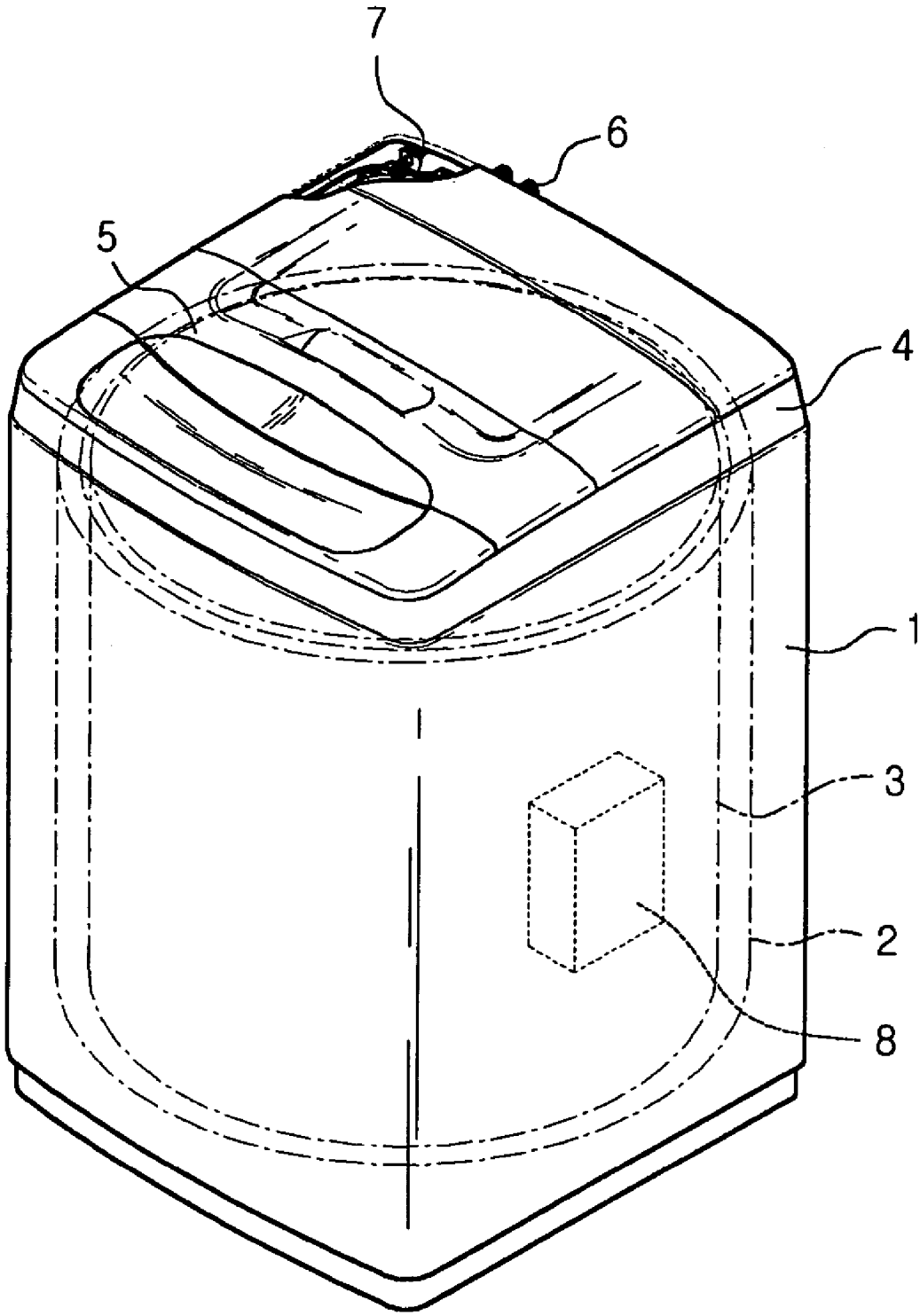
FIG. 1 is a perspective view of a conventional washing machine.
Figure 2:
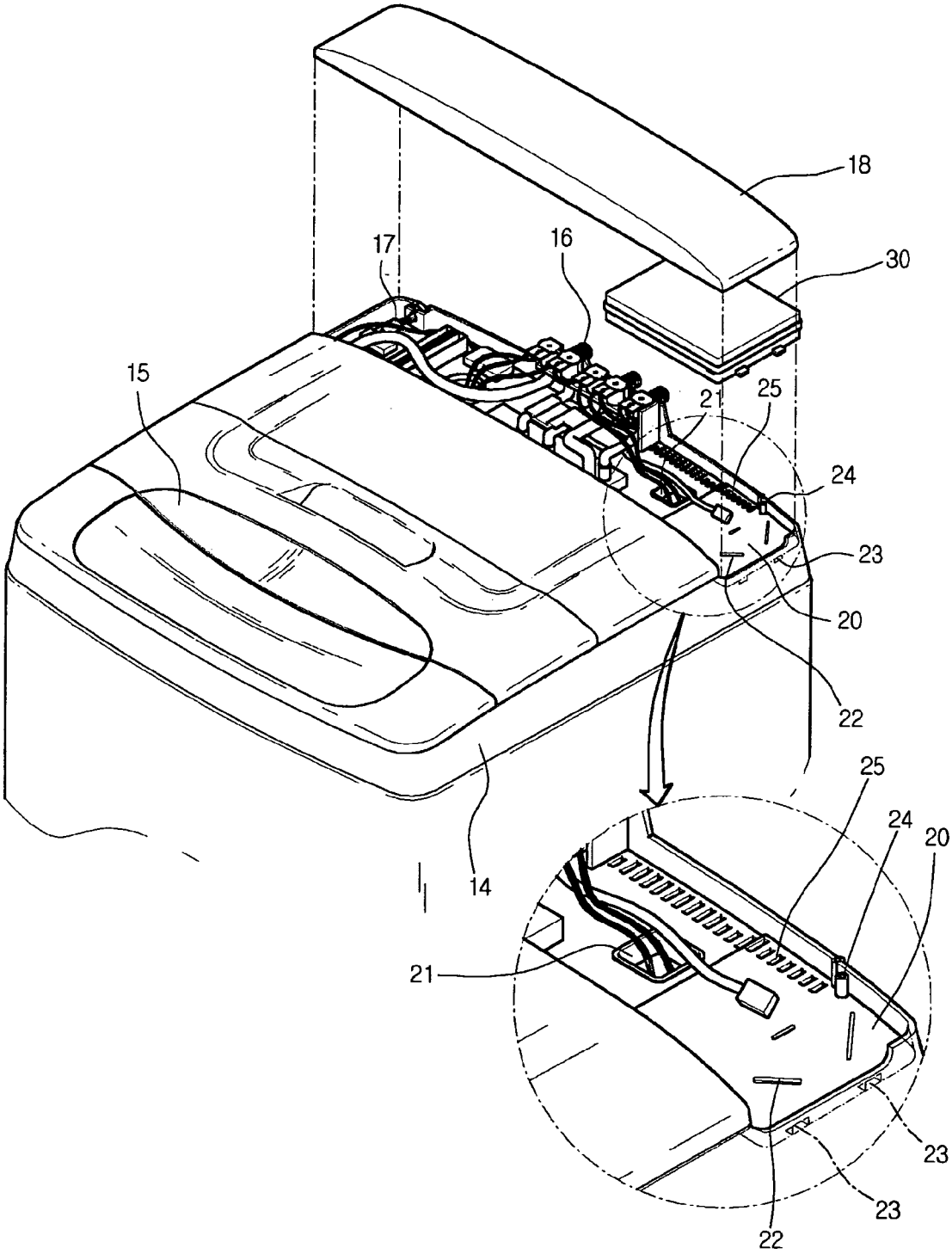
FIG. 2 is a perspective view of a washing machine employing a control box assembly according to a preferred embodiment of the present invention.
Figure 3:
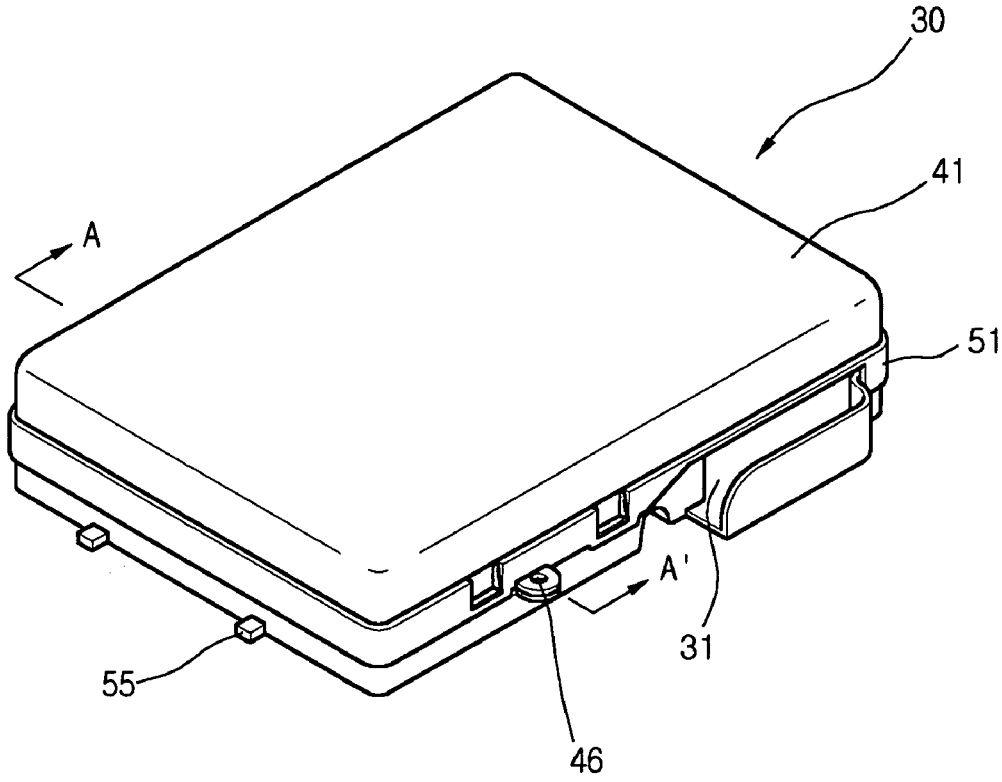
FIG. 3 is a perspective view of a control box according to a preferred embodiment of the present invention.

FIG. 2 shows a washing machine employing a control box assembly according to a preferred embodiment of the present invention, and FIG. 3 shows a control box according to a preferred embodiment of the present invention.

As shown in the drawings, the inventive washing machine, as in the conventional washing machine, comprises a top cover 14, a top lid 15, a water supplying part 16, and a mechanical part 17. The washing machine further comprises a protecting cover 18 covering a rear portion of the top cover 14.

The top cover 14 is provided with a control box-receiving portion 20 that is defined by indenting the rear portion of the top cover 14. That is, the control box-receiving portion 20 is defined by a bottom and a sidewall. A control box 30 is gently seated in the control box-receiving portion 20.

A complicated electrical wiring with a plurality of control and electric wires is extended from the control box 30.

The control box-receiving portion 20 is provided with a wire-through hole 21 formed on the bottom; at least one protruded rib 22 formed on the bottom; seating grooves 23 formed on the sidewall to securely fix the received control box 30; and a plurality of heat discharge vents 25 formed on the bottom to quickly discharge heat generated in the control box 30 to the air.

The control box 30 is provided with a screw insertion hole 46 that is aligned with a screw insertion hole 24 of the control box-receiving portion 20 so that the control box 30 is securely fixed on the control box-receiving portion 20 by a screw (not shown) inserted through the screw insertion holes 46 and 24; and seating guides 55 for guiding a seating location of the control box 30. The screw insertion hole 46 and the seating guides 55 are formed on a sidewall of the control box 30.

The control box 30 comprises upper and lower boxes 41 and 51 that are assembled each other.

Mounted on the control box 30 are a plurality of electric parts connected to external parts through a plurality of electric wires. Therefore, the control box 30 is provided with a plurality of incoming/outgoing wire holes 31.

Describing in more detail, two of the wires entering into and exiting from the control box 30, one is for supplying electric power to a driving motor and the other is for applying control signals for the driving motor, extend downward of the washing machine through the wire-through hole 21 formed on the control box-receiving portion 20.

The protruded rib(s) 22 is provided to maintain a predetermined gap between the bottom of the control box 30 and the bottom of the control box-receiving portion 20.

The seating grooves 23 of the control box-receiving portion 20 are associated with the seating guides 55 of the control box 30 such that a seating location of the control box 30 can be guided in the course of seating the control box 30 in the control box-receiving portion 20. That is, the association of the seating guides 55 with the seating grooves 23 is an initial process for receiving the control box 30 in the control box-receiving portion 20, thereby accurately guide the seating location of the control box 30 in the control box-receiving portion 20. This provides a more convenient assembling process in an assembling line of a manufacturing factory.

The combination of the control box 30 and the control box-receiving portion 20 will be described in more detail hereinafter.

A plurality of circuit parts are mounted in the control box 30, and the control box 30 supplies electric power to other electric parts and transmits control signals.

That is, the control box 30 receives external electric power to output electric power for driving the driving motor. The control box 30 further receives water level signals from a water level sensor and outputs control signals to a water supply valve.

Particularly, as the control box 30 is located on the top of the washing machine, distances between the mechanical part 17 and the control box 30, between the water supplying part 16 and between an external power source and the control box 30 are remarkably reduced, while a distance between the driving motor and the control box 30 is increased.

Meanwhile the control box 30 is preferably formed of an uninflammable material in case of fire due to a spark and the like.

FIG. 2 shows a plurality of wires arranged in the washing machine of the present invention.

The disposition of the control box 30 on the top cover 14 provides another advantage of preventing water drops from forming therein. In addition, since the control box 30 is located at a location that is remote from the washtub, the risk of infiltration of washing water into the control box 30 can be remarkably reduced.

The disposition of the control box 30 on the top cover 14 further provides another advantage of easy access thereto by simply removing the protecting cover 18 covering the rear portion of the top cover 14, thereby making it easy to perform repairs thereof.

The assembling process of the control box will be described hereinafter.

First, the control box 30 is seated on the control box-receiving portion 20 formed on the top cover 14, while the seating guides 55 formed on the control box 30 are guided in the seating grooves 23 of the control box-receiving portion 30.

Then, a coupling member (i.e., a screw) is screw-coupled through the screw insertion hole 24 of the control box-receiving portion 20 and the screw insertion holes 46 and 57 formed on the control box 30, thereby securely fixing the control box 30 on the control box-receiving portion 20.

After the above, the protecting cover 18 is disposed covering the rear portion of the top cover 14, thereby completing the assembling process of the control box 20.

The structure of the control box 30 will be described in more detail hereinafter with reference to accompanying drawings.

Figure 4:
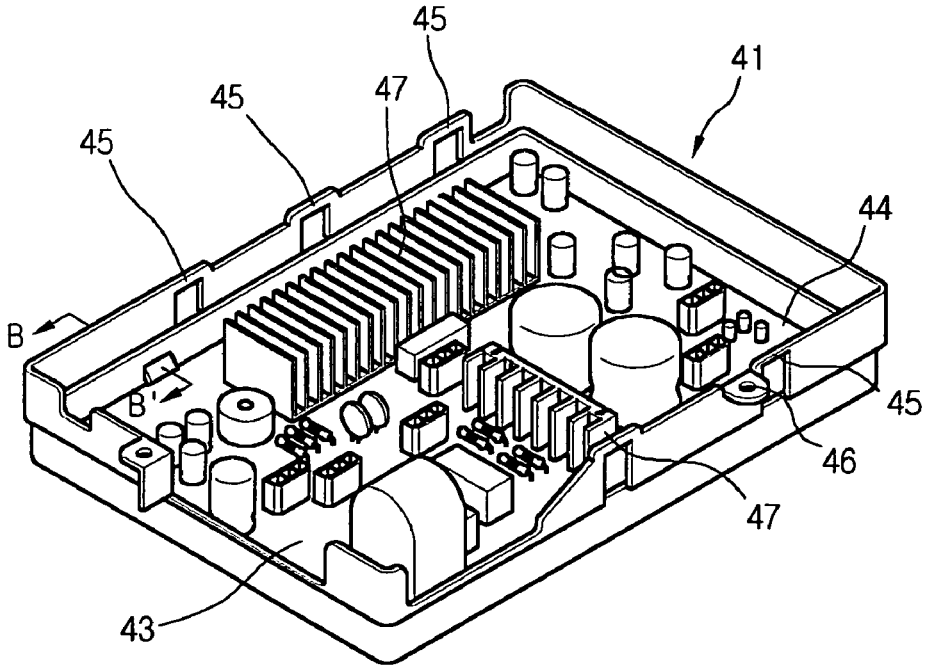
FIG. 4 is a perspective view of an upper box of a control box according to a preferred embodiment of the present invention.

FIG. 4 shows a bottom perspective view of the upper box of the control box.

As shown in the drawing, the upper box 41 has a bottom and a sidewall. A circuit board 43 on which a plurality of electric parts are mounted is disposed in the upper box 41. A plurality of board holders 42 are formed on an inner surface of the sidewall of the upper box 41 to fix the circuit board 43, and a waterproof coating layer 44 is formed on the circuit board 43 to more securely fix the circuit board 43. A plurality of coupling loops 45 are formed on the sidewall of the upper box 41, and a heat discharge member 47 for discharging heat generated from the electric parts formed on the circuit board 43 is provided on the circuit board 43.

Figure 5:
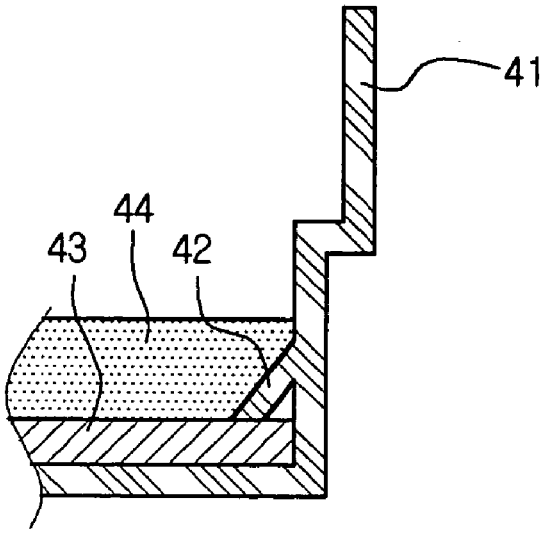
FIG. 5 is a sectional view taken along line B-B' of FIG. 4.

As shown in FIG. 5, which is a sectional view taken along line B-B of FIG. 4, the board holders 42 are provided to accurately fix the seating location of the circuit board 42. That is, each of the board holders 42 is formed extending inward and downward from the inner surface of the sidewall of the upper box 41.

The coating layer 44 is formed by applying a liquid resin material that is, for example, a polyurethane-based material, and hardening the material. The coating layer 44 is formed covering the entire surface of the circuit board 43 to prevent the washing water from contacting the circuit board 43.

Coupling hooks 56 formed on the lower box 51 (see FIG. 6) are inserted in the corresponding coupling loops 45 to couple the upper and lower boxes 41 and 51 to each other.

The heat discharge member 47 is disposed contacting the heat-generating parts on the circuit board 47, thereby quickly discharging the heat generated from the heat-generating parts to the outside.

Referring again to FIG. 5, the holders 42 are designed to be elastically deformable by extending downward from the inner surface of the sidewall of the upper box 41.

That is, when the circuit board 43 is inserted under the holders 42, the holders 42 are elastically deformed toward the sidewall of the upper box 41, and when the circuit board 43 is removed from the holders 42, the holders 42 are restored to their initial location while being deformed away from the sidewall of the upper box 41. Accordingly, when the circuit board 43 is disposed in the upper box 41, the lower ends of the holders 42 contact the top of the circuit board 43, thereby securely fixing the circuit board 43.

After the circuit board 43 is fixed by the holders 42, the liquid coating material is applied to entirely coat the top of the circuit board 43, while closely filling all the gaps between the upper box, the circuit board, and the electric parts.

Meanwhile, a thickness of the coating layer 44 is determined such that it can cover at least a printed circuit and expose the heat discharge member to external air.

Figure 6:
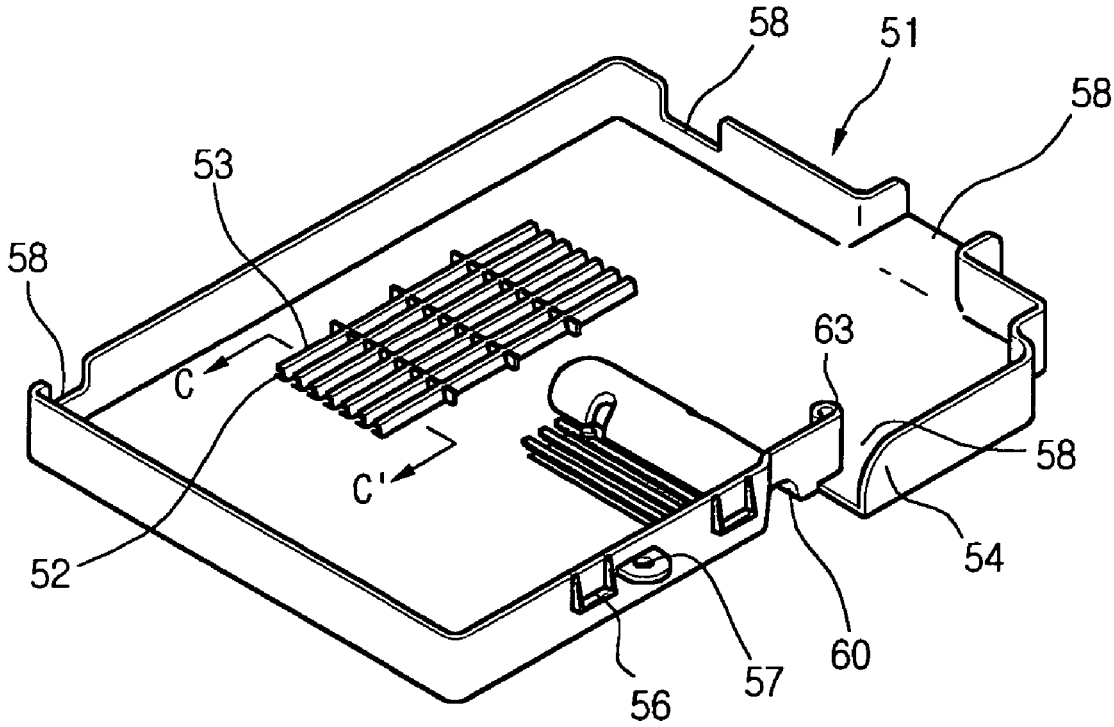
FIG. 6 is a top perspective view of a lower box of a control box according to a preferred embodiment of the present invention.

FIG. 6 shows a top perspective view of the lower box of the control box.

The lower box 51 has a bottom and a sidewall, and the coupling hooks 56 are formed on the sidewall of the lower box 51. By coupling the coupling hooks 56 of the lower box 51 with the coupling loops 45 of the upper box 41, the upper and lower boxes 41 and 51 are firstly fixed to each other. Then, by inserting a screw member into the screw insertion holes 46 and 57, the upper and lower boxes 41 and 51 are securely fixed.

A plurality of vents 52 are formed through the bottom of the lower box 51 to dispatch the heat out of the control box 30, and water splash preventing guards 53 extend from the peripheries of the vents 52 to prevent water from splashing into the control box 30. The water splash preventing guards 53 are bent at a predetermined angle. The lower box 51 is provided at its sidewall with a plurality of incoming/outgoing wire notches 58 through which wires enter or exit the control box 30, and a wire guide 54 for guiding the incoming/outgoing wires. A curved portion 63 is formed on a portion of the sidewall of the lower box 51, that the wires coming in or going out through the wire guide 54 contact, to prevent the wires from being damaged by an acute corner. A wire guide groove 60 on which the wires entering and exiting through the wire guide 54 are gently disposed is formed on an outer surface of the bottom of the lower box 51.

Describing in more detail, the vents 52 are formed being aligned with the fins of the heat discharge member 47 of the upper box 41, so that the heat generated from the circuit board 43 can be quickly dispatched out of the control box 30.

The water splash preventing guards 53 are formed extending upward from the bottom of the lower box 51, being bent horizontally to prevent water from splashing into the control box 30.

The incoming/outgoing wire notches 58 are portions through which the wires enter and exit. The wires passing the outer surface of the bottom of the lower box 51 through the incoming/outgoing wire notches 58 are guided to the wire groove 60 by the wire guide 54.

The wires exiting through the wire guide 54 may be damaged by contacting a corner of the sidewall. Therefore, to prevent this, the curved portion 63 is formed on the corner of the sidewall. The curved portion 63 is formed by bending one end of the sidewall inward.

The screw insertion hole 57 is aligned with the screw insertion hole 46 of the upper box 41 such that the screw can be screwed through the screw insertion holes 57 and 46. The inserted screw is further screwed into the screw insertion hole 24 (see FIG. 2) formed on the top cover 14, thereby securely fixing the upper and lower boxes 41 and 51 on the top cover 14.

The coupling hooks 56 are formed corresponding to the coupling loops 45 (see FIG. 4) such that they can be inserted into the coupling loops 45, thereby fixing the coupling location of the upper and lower boxes 41 and 51.

Figure 7:
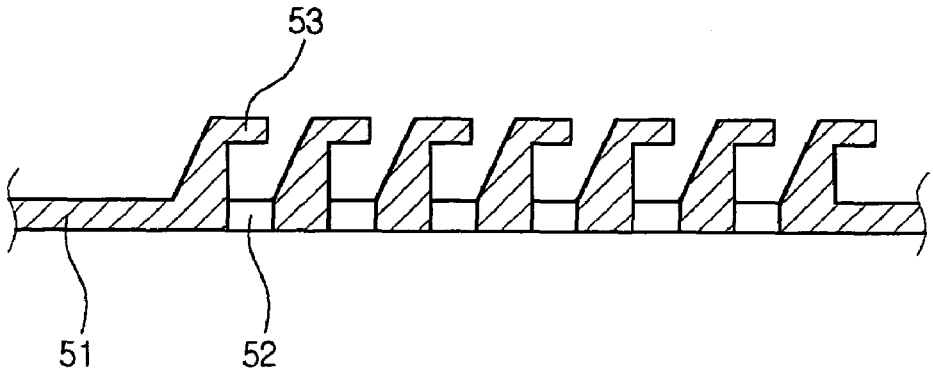
FIG. 7 is an enlarged view illustrating vents and water splash preventing guards depicted in FIG. 6.

FIG. 7 shows a detailed drawing illustrating the vents and the water splash guards, which is a sectional view taken along line C-C'.

The vents 52 formed on the bottom of the lower box 51 are shaped in longitudinal slots and aligned with the fins of the heat discharge member 47. The water splash preventing guards are extended from the peripheries of the vents 52 and bent horizontally to be formed in an L-shape.

By the above structure, even when the water is splashed toward the control box 30, the water does not infiltrate the control box 30 because it is intercepted by the water splash preventing guards 53 and directed downward.

Figure 8:
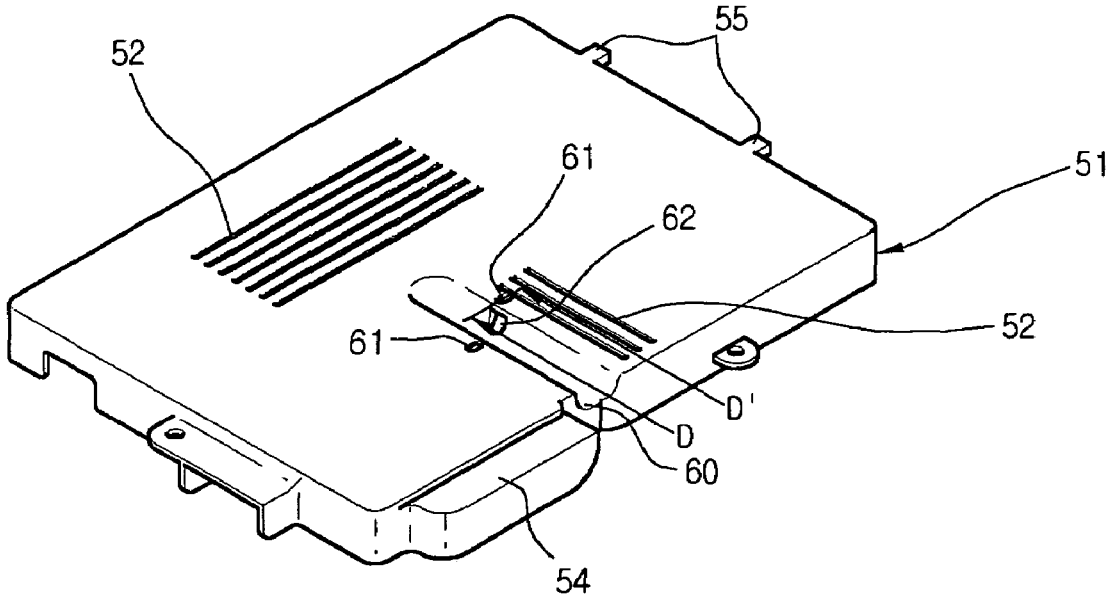
FIG. 8 is a bottom perspective view of a lower box of a control box according to a preferred embodiment of the present invention.

FIG. 8 shows a bottom perspective view of the lower box.

As shown in the drawing, the wire guide groove 60 is provided on the outer surface of the bottom of the lower box 51. The wires are gently disposed in the wire guide groove 60.

The wire guide groove 60 is provided with a pair of cable tie insertion holes 61 and a cable tie guide 62 that is smoothly curved to guide the cable tie into the wire guide groove 60.

The seating guides 55 are projected outward from the sidewall of the lower box 51 to allow the control box 30 to be stably seated on the control box-receiving portion 20. That is, the seating guides 55 are associated with the seating grooves 23 formed on the sidewall of the control box-receiving portion 20.

Figure 9:
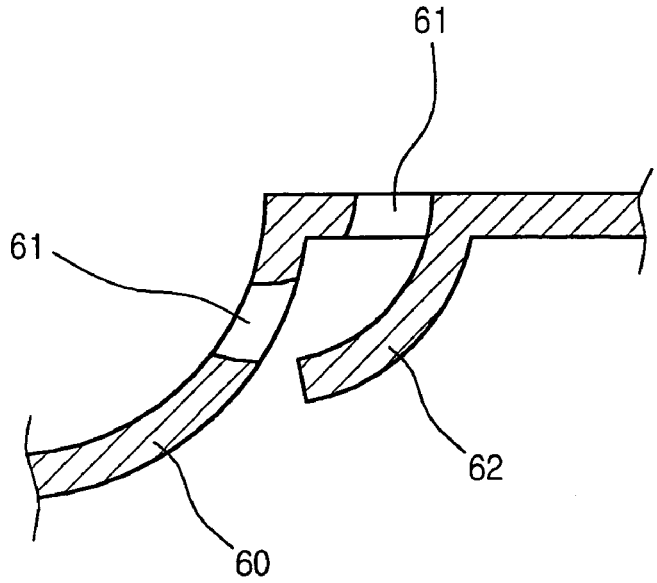
FIG. 9 is a sectional view taken along line D-D' of FIG. 8.

FIG. 9 shows a sectional view taken along line D-D' of FIG. 8, illustrating a detailed structure of the cable tie insertion holes and the cable tie guide.

The pair of cable tie insertion holes 61 are respectively formed on the wire insertion groove 60 and the plane surface of the bottom of the lower box 51. The cable tie guide 62 guides the cable tie into the wire guide groove 60. That is, the cable tie inserted through the cable tie insertion hole 61 formed on the plane surface of the bottom of the lower box 51 comes out through the cable tie insertion hole 61 formed on the wire guide groove 60. At this point, the cable tie inserted in the cable tie guide 6 can be easily withdrawn into the cable tie insertion hole 61 formed on the wire guide groove 60 by an outward pushing force.

Meanwhile, the innermost location of the wire guide groove 60 is aligned with the wire-through hole 21 of the top cover such that the wire guided by the wire guide groove 60 can be stretched into the washing machine through the wire-through hole 21.

In addition, one end of the cable tie is inserted into the cable tie insertion holes 61.

Describing in more detail, the cable tie is inserted through the cable tie insertion hole 61 formed on the plane surface of the bottom of the lower box 51, and is then withdrawn to the wire guide groove 60 through the cable tie insertion hole 61 formed on the wire guide groove 60. At this point, in order to allow the cable tie to be smoothly guided into the wire guide groove 60, the cable tie guide 62 is curved toward the wire guide groove 60.

In addition, after the insertion of the cable tie through the cable tie insertion holes 61, the wires are snugly located in the cable tie. By fastening the cable tie, the wires are stably located on the outer surface of the control box 30. Furthermore, in order to let the wires be stably located on both sides of the wire guide groove 60, two sets of the cable tie insertion holes 61 and the cable tie guide 62 may be formed on each side of the wire guide groove 60, respectively. The locations of the two sets are away from each other so that the two sets cannot be obstacles to installation of the wires at both sides of the wire guide groove 60.

As described above, when the control box 30 is located in the control box-receiving portion 20 in the production line, since the plurality of wires stretched out of the control box 30 are fixed by the cable ties, the control box 30 can be more conveniently installed into the control box-receiving portion 20.

Figure 10:
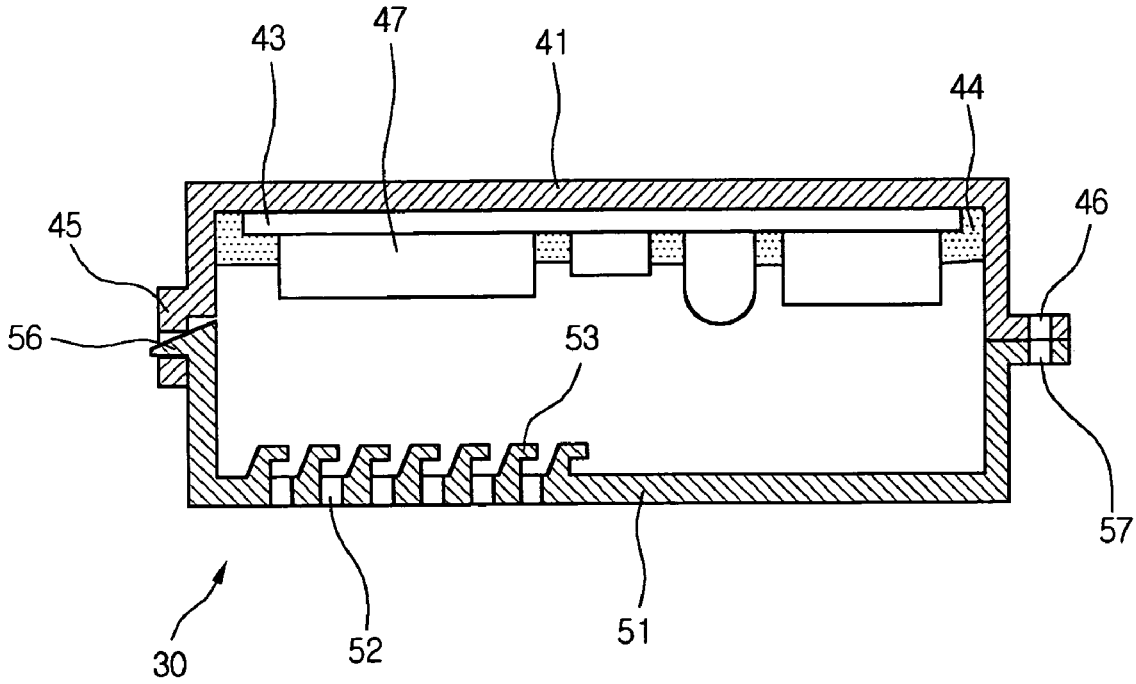
FIG. 10 is a sectional view taken along line A-A' of FIG. 3.

FIG. 10 shows a sectional view taken along line A-A' of FIG. 3, illustrating the control box.

As shown in the drawing, the control box 30 is defined by the upper and lower boxes 41 and 51 that are preliminarily assembled with each other by the association of the coupling hooks 56 and the coupling loops 45. After the preliminarily assembly, the screw is screw-coupled through the screw insertion holes 46, 57, and 24, thereby securely fixing the control box in the control box-receiving portion 20.

As described above, in the present invention, since the vents 52 are formed being aligned with the fins of the heat discharge member 47, the cooling efficiency of the heat discharge member 47 can be improved. In addition, since the vent 52 is covered by the water splash preventing guards 53, the water can be prevented from being splashed into the control box 30.

Furthermore, since the circuit board 43 preliminarily assembled in the upper box 41 is covered by the coating layer formed by applying liquid resin and hardening the same, all of the gaps between the circuit board, the box, and other electric parts can be completely sealed, thereby improving the reliability with respect to protection from moisture.

In addition, since the circuit board 43 is disposed in the upper box 41 in a state where it is turned over, there is no risk of a short circuit caused by water. Even when water contacts the circuit board, the water immediately drops downward.

INDUSTRIAL APPLICABILITY

The present invention has an advantage of suppressing short circuits that may be caused by water infiltrating the control box, thereby reducing the risk for fire caused by the circuit short.

The present invention has another advantage of making it easy to install and repair the control box.

The present invention has still another advantage of reducing the manufacturing cost by changing the installing location of the control box.

The present invention has still yet another advantage of improving the reliability of the control box by suppressing the control box from being exposed to moisture.

The invention claimed is:

1. A washer comprising:

an outer cabinet;

a washtub disposed in the cabinet;

a rotating tub rotating by a driving motor and being disposed in the washtub;

a top cover disposed on top of the cabinet, the top cover being provided with an opening for loading and unloading clothes;

a control box-receiving portion formed on a portion of the top cover by indenting the rear portion of the top cover;

a control box adapted to be splash resistant in proximity to a water supplying part of the washer, having:

a circuit board for controlling the washer, the control box removably received in the control box-receiving portion; and a protecting cover for covering the portion of the top cover where the control box is received.

2. The washer according to claim 1, wherein the control box comprises upper and lower boxes that are separated from each other.

3. The washer according to claim 2, wherein one of the upper and lower boxes is provided with a plurality of coupling hooks and the other of the upper and lower boxes is provided with a plurality of coupling loops associated with the coupling hooks.

4. The washer according to claim 2, wherein the circuit board is mounted on an inner surface of a bottom of the upper box.

5. The washer according to claim 4, wherein the upper box is provided with at least one board holder for firstly fixing the circuit board.

6. The washer according to claim 4, wherein the circuit board is secondly fixed by an urethane coating layer deposited on a surface of the circuit board.

7. The washer according to claim 2, wherein at least one of the upper and lower boxes is provided with a screw insertion hole.

8. The washer according to claim 7, wherein at least one of the upper and lower boxes is securely coupled on the top cover by a screw inserted through the screw insertion hole.

9. The washer according to claim 2, wherein vents are provided on the lower box.

10. The washer according to claim 9, wherein the vents are formed being aligned with fins of a heat discharge member for cooling the circuit board.

11. The washer according to claim 9, wherein the lower box is further provided with water splash preventing guards extending from peripheries of the vents to guards of the vents at a spaced distance.

12. The washer according to claim 1, wherein at least one seating groove is formed on a sidewall defining the control box-receiving portion, and at least one seating guide inserted into the seating groove is formed on a sidewall of the control box.

13. The washer according to claim 1, wherein the control box is provided with at least one incoming/outgoing wire hole.

14. The washer according to claim 13, wherein the control box is provided with a wire guide groove for guiding a wire coming out through the incoming/outgoing wire hole.

15. The washer according to claim 13, wherein the wire guide groove is provided with a cable tie insertion hole.

16. The washer according to claim 13, wherein a portion of a sidewall of the control box, which is adjacent to the incoming/outgoing wire hole, is provided with a curved portion for preventing the wire from being damaged.

17. The washer according to claim 13, wherein the control box is provided with a wire guide for guiding the wire into or from the control box through the incoming/outgoing wire hole.

18. The washer according to claim 1, wherein at least one projection rib is formed on a bottom defining the control box-receiving portion to maintain a predetermined gap between the bottom of the control box-receiving portion and a bottom of the control box.

* * * * *